US009696127B2

(12) United States Patent
Hubert-Habart et al.

(10) Patent No.: US 9,696,127 B2
(45) Date of Patent: Jul. 4, 2017

(54) METHOD AND SYSTEM FOR DETECTING IMPROVISED EXPLOSIVE DEVICES OR THE LIKE

(75) Inventors: Christophe Hubert-Habart, Meudon (FR); David Monnin, Pfastatt (FR)

(73) Assignees: THE FRENCH-GERMAN RESEARCH INSTITUTE OF SAINT LOUIS (ISL), Saint Louis (FR); MBDA FRANCE, Paris (FR)

( * ) Notice: Subject to any disclaimer, the term of this patent is extended or adjusted under 35 U.S.C. 154(b) by 1353 days.

(21) Appl. No.: 13/132,133

(22) PCT Filed: Nov. 25, 2009

(86) PCT No.: PCT/FR2009/052293

§ 371 (c)(1),
(2), (4) Date: Jun. 1, 2011

(87) PCT Pub. No.: WO2010/063920

PCT Pub. Date: Jun. 10, 2010

(65) Prior Publication Data

US 2011/0228090 A1 Sep. 22, 2011

(30) Foreign Application Priority Data

Dec. 2, 2008 (FR) ..... 08 06758

(51) Int. Cl.
*H04N 7/18* (2006.01)
*F42D 5/02* (2006.01)
*F41H 11/12* (2011.01)

(52) U.S. Cl.
CPC ..... *F42D 5/02* (2013.01); *F41H 11/12* (2013.01)

(58) Field of Classification Search
CPC ..... H04N 2201/32; G08B 13/1969; G08B 13/196; G08B 13/196; G01C 11/00; F42D 5/02; F41H 11/12
(Continued)

(56) References Cited

U.S. PATENT DOCUMENTS

2007/0061076 A1* 3/2007 Shulman ..... 701/213
2008/0204571 A1* 8/2008 Hoglund et al. ..... 348/222.1

FOREIGN PATENT DOCUMENTS

GB 2 103 901 A 2/1983
GB 2103901 A * 2/1983
(Continued)

OTHER PUBLICATIONS

International Search Report completed Mar. 22, 2010 and mailed Mar. 30, 2010 from corresponding International Application No. PCT/FR2009/052293, filed Nov. 25, 2009 (6 pages).
(Continued)

*Primary Examiner* — Gims Philippe
*Assistant Examiner* — Joseph Becker
(74) *Attorney, Agent, or Firm* — Klein, O'Neill & Singh, LLP

(57) ABSTRACT

The present disclosure relates to method and system for detecting improvised explosive devices or the like. According to the present disclosure, the method is of the image-correlation type and involves continuously delivering current images representative of said path followed by a vehicle, in replacing some of said current images with pre-recorded earlier images taken at the same point, and in displaying said current images and said replacement earlier images in succession in order to detect said explosive devices.

19 Claims, 1 Drawing Sheet

(58) Field of Classification Search
USPC ..... 348/148
See application file for complete search history.

(56) References Cited

FOREIGN PATENT DOCUMENTS

| | | | | |
|---|---|---|---|---|
| GB | 2 243 266 | A | | 10/1991 |
| GB | 2 439 627 | A | | 1/2008 |
| GB | 2439627 | A | * | 1/2008 |
| JP | 10 307110 | A | | 11/1998 |
| ZA | 9 510 950 | A | | 7/1996 |

OTHER PUBLICATIONS

Written Opinion completed Mar. 22, 2010 and mailed Mar. 30, 2010 from corresponding International Application No. PCT/FR2009/052293, filed Nov. 25, 2009 (12 pages).

* cited by examiner

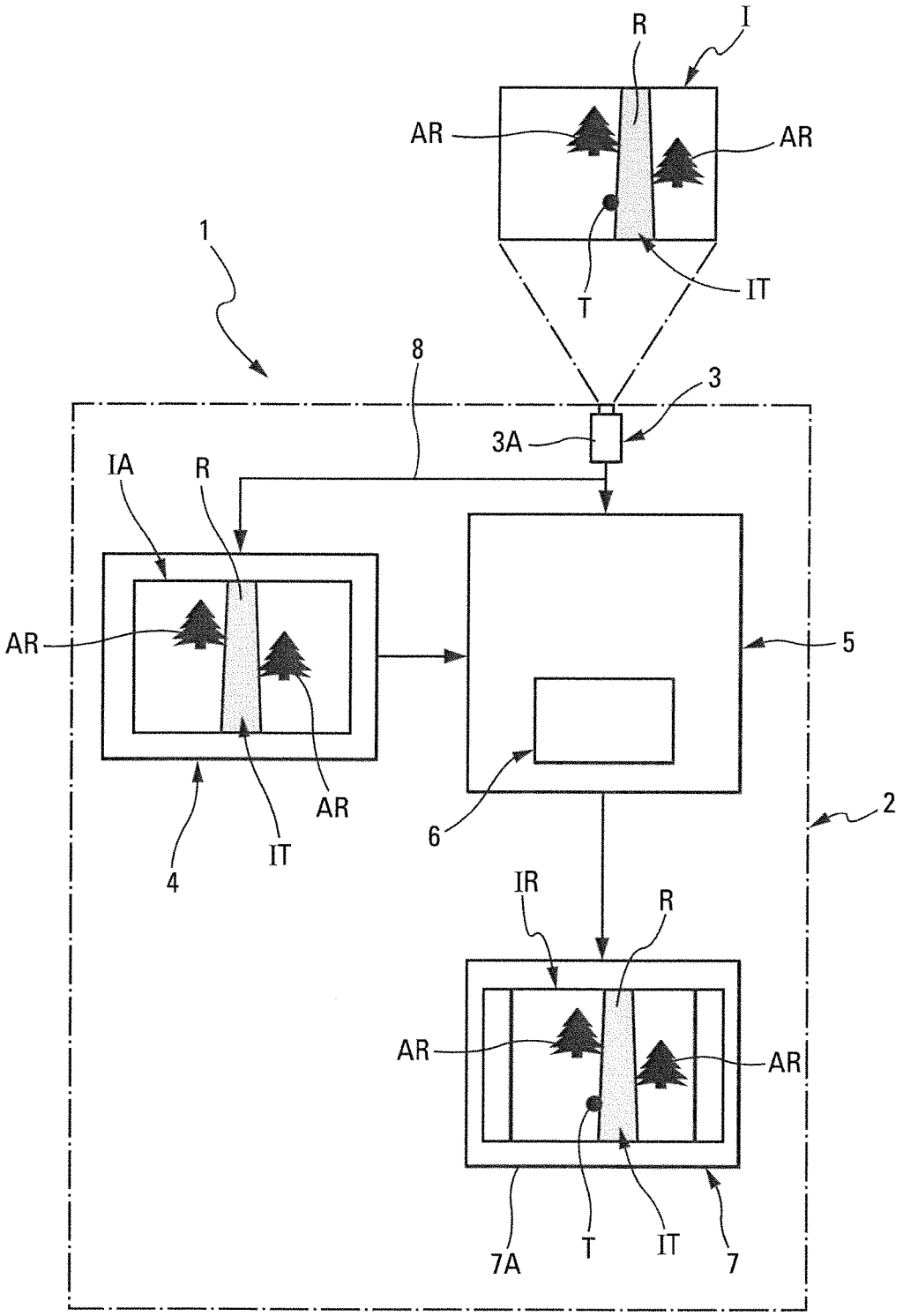
R
I
AR
AR
1
T
IT
8
3
3A
IA
R
AR
5
AR
IT
4
6
2
IR
R
AR
AR
7A
T
IT
7

METHOD AND SYSTEM FOR DETECTING IMPROVISED EXPLOSIVE DEVICES OR THE LIKE

CROSS-REFERENCE TO RELATED APPLICATION(S)

This is a national phase application under 35 U.S.C. §371 of PCT Application No. PCT/FR2009/052293, filed Nov. 25, 2009. which claims the benefit of French application No. 08/06758 filed Dec. 2, 2008, the contents of which are expressly incorporated herein by reference.

FIELD OF ART

The present disclosure relates to a method and a system for detecting improvised explosive devices (EEI) or the like.

BACKGROUND

It is known that improvised explosive devices are more and more used for booby-trapping a path, such as a road or a lane and the verges thereof, of a conflict area, as they are easily concealed as a result of their small size and they could he designed and manufactured quite easily and traditionally from commercially available components and/or components mounted on commodity materials and devices being diverted from their initial application. Therefore, they are an important threat for civil or military vehicles and individuals, which follow such booby-trapped paths.

In order to secure such a road or lane, destructive systems could be used, being coupled to motorised vehicles and based on decoying or neutralization mechanisms triggering, when they drive on such devices, the explosion of their explosive, resulting furthermore in a damage of part of such non destructive mechanisms or systems relating to the present method, system and device and allowing explosive devices to be detected and thus, said devices to be located from, amongst others, X-rays or neutron analyses.

However, such systems are difficult to be applied to a vehicle intended for detecting explosive devices because, more specifically:

- of too a high deadline of the measures, being detrimental o the progression of the vehicle,
- of a low range of systems being lower than a few meters, and
- of the laws over the use of X rays or neutron rays on individuals.

SUMMARY

The present method, system and device aim at overcoming such drawbacks and relates to a method and a system for detecting improvised explosive devices, which can be usable on a moving vehicle while being not constrained to the individuals present in the vehicle or close to the latter.

To this end, the method for detecting improvised explosive devices or the e like, partially or totally concealed on a path or in the vicinity of the latter, from a vehicle following said path, is remarkable, according to the present method, system and device, in that it is of the image correlation type and consisting, upon a detection mission:

- in continuously delivering current images representative of said path being followed;
- in replacing at least some of said current images with pre-recorded earlier images, taken at the same point; and

- in successively displaying said current images and said earlier replacement images in order to allow, through the correlation of the current and earlier images, the detection of said explosive devices.

Thus, thanks to the present method, system and device, the method for detecting through image correlation is completely passive as it does not emit any hazardous radiation and is not consequently submitted to regulatory constraints of use, so that it can be technically very easily implemented. Such an image analysis method allows a change to be noticed in the current image, as compared to an earlier image, which change could correspond to the presence of an explosive device, and consequently operates in real time with a moving vehicle.

Preferably, in order to obtain an optimum analysis of the path followed by the vehicle, the method comprises the steps of replacing one current image out of two by one earlier image and successively displaying said thus alternating current images and earlier images. Alternated groups of images (of more of two images) could also be displayed. Any change between the images (or groups of images) representative of the road and its surroundings is thus emphasized, step by step, along the path, enabling to secure it to the best.

Advantageously, the method further comprises, before said current images and earlier images are displayed, fixing the geographical position of said successive current and earlier images, so that fixed points of said successive images match.

The present method, system and device also relate to a system for detecting improvised explosive devices or the like, intended for implementing the previously defined method.

To this end, the system is remarkable in that it comprises:

- at least one shooting source mounted on said vehicle following said path and delivering said current images of the latter:
- a database of said pre-recorded earlier images of said path;
- a device for processing images in real time to which said shooting source and said data base are connected and which replaces at least some of said current images with earlier images from said data base, taken at the same point of said path; and
- a device for displaying said current and earlier images thus combined by said processing device.

Thus, such a system is easily integrated into a vehicle as a result of its reduced size and furthermore consumes little energy for its operation, as its shooting source is a simple camera and its displaying device a monitor. The detecting range of the system could be high as it depends on the resolution of the sensor and of the features of the objective lens of the camera. A range of some tens to some hundreds of metres is thus achievable as a function of the size of the objects to be detected.

Advantageously, said processing device replaces one current image out of two taken by said source with one previous image from said data base, so as to visualize on said displaying device, an alternated succession of said current and earlier images.

According to another feature, the system further comprises a means for fixing the geographical position of two respectively successive and earlier images, so that fixed points of said images match.

Preferably, said earlier image data base contains images supplied by the same shooting source, so imparting a high reliability to the system.

Furthermore, said current images supplied by said source are sent into said data base, so that the latter is regularly updated each time the vehicle follows the path.

BRIEF DESCRIPTION OF THE FIGURE

The sole FIGURE of the appended drawing will better explain how the present method, system and device can be implemented.

The FIGURE schematically shows the system for detecting improvised explosive devices implementing the method according to the present method, system and device.

DETAILED DESCRIPTION

The detection system 1 according to the present disclosure is mounted on-board a vehicle 2 generally of the military type, symbolized with a rectangular mixed line and following a path (road or lane) likely to comprise improvised explosive devices that could be either totally or partially buried and/or concealed in the road or on the verges thereof.

To this end, the system comprises, as will he described in detail herein under, a shooting source 3 of current images I, a data base 4 of reference earlier images IA of said path, an image processing device 5, a fixing image means 6 and a display device 7.

In particular, the shooting source 3 is a camera 3A on-board the vehicle 2 and allowing to take the current images I of the path and to thereby visualize on the display device 7 the road and the verges of the path followed by the vehicle, so as to deliver in real time and continuously, the current images of the path.

The data base 4 contains earlier images IA of the same path, but previously filmed and contained on any appropriate storing computer medium integrated into the vehicle. Such images could have been taken by the same camera upon a previous passage on the same path.

The image processing device 5 is connected to the camera 3A and to the data base 4 and thereby receives the information (images I and IA) sent by the camera 3A and the data base 4. The processing device 5 aims at replacing the current images I delivered by the camera by removing and then substituting the removed current images with earlier images IA supplied by the data base 4 and located at the same point. In order to optimize the detection of explosive devices along the path, one current image I out of two is replaced with one earlier image IA, so that the alternate display of the current images I of the camera and of the earlier images IA of the data base could allow to immediately see the changes having occurred along the current path, as compared to the pre-recorded one. For visualizing this, the display device 7 is for instance a viewing monitor 7A.

Thus, as shown on the FIGURE, the two supplied images, respectively the current I and the earlier IA ones, at a given instant at a same point, might not be perfectly identical, as far as their spatial geographic position is concerned. It is due more particularly to the fact that the vehicles do not follow exactly the same way along the path and or the cameras are not arranged at the same point on the vehicles. It can thus be seen that the road R of the path IT with its two trees AR of the current image I delivered by the camera 3A is slightly offset to the right as compared to the same road R of the path IT with the same two trees AR of the earlier image IA delivered by the data base 4, said road being located in the middle of the earlier image IA.

The system 1 of the present disclosure contemplates this and its fixing means 6 could consist in several interventions, for instance: either fixing the current image I filmed by the camera 3A with that IA of the data base 4 from the position of the vehicle or from both the position of the vehicle and the orientation of the camera, so as to superimpose said images I and IA, or using an equipment belonging to the detection system 1 or using a specific equipment of the vehicle, such as a satellite positioning system, an inertial unit, if it has any, such an equipment allowing to know where the images I and IA have been taken, thereby facilitating the fixing thereof. As shown in the FIG. 1, a common portion of the superimposed images I and IA is shown on the viewing monitor 7A of the display device 7.

Such a fixing of the current images I and the earlier images IA is also necessary for ensuring a good visual comfort to the operator being in charge of monitoring the images alternately scrolling on the viewing monitor 7A.

The thus described system 1 could spot, through image correlation, any change occurring between successive images scrolling on the monitor 7A. For instance, it can he seen that on the current image I shown and delivered by the camera 3A, as well as on the fixed image IR on the monitor 7A, there is a black spot T, on the left verge of the road R, whereas it does not occur on the earlier image IA. Thus, thanks to the alternate display of current and earlier images in the data base, the operator sees some flickering on the monitor 7A representative of the change between the successive images and corresponding in the example to the spot T, which might be an improvised explosive device. Should this be the case, the latter being thereby detected is then neutralized.

During or at the end of the mission of the vehicle, the images taken by the camera during the move are used to fill, via a link 8, the data base 4, being thereby updated. Replacing old images with recent images allows not the slow natural changes in the landscape to be considered, such as, for instance, those of the vegetation.

In order to aid the operator in construing, the image processing device 5 could be automatically carried out for detecting and emphasizing the elements having been modified in the landscape.

Furthermore, the image processing device 5 could also act on the images so as to reduce the effect of variations of brightness or of shadows being cast between the two images that have been taken at different instants.

The referenced image data base 4 could obviously been shared between several vehicles able to follow for instance the same portion of the path.

The invention claimed is:

1. A method for detecting improvised explosive devices, partially or totally concealed on a path or in a vicinity thereof, using a vehicle following said path during a detection mission, said method comprising:

continuously delivering current images representative of said path being followed to an image processing device;

using the image processing device to replace at least some of said current images by removing and substituting the removed at least some current images with a number of substituted stored images, said substituted stored images being pre-recorded earlier images taken earlier in time of said path and stored in a database;

using the image processing device to form an ordered combination of said current image less said removed at least some current images and said number of substituted stored images displaying the ordered combination of said current images less said removed at least some current images and said number of substituted stored images to enable, through correlation of the current images less said removed at least some current images and the number of substituted stored images, detection of said explosive devices; and updating said pre-recorded earlier images with said current images continuously delivered to said image processing device.

2. The method according to claim 1, wherein said replacing step comprises replacing one current image out of two current images with one pre-recorded earlier image and successively displaying said current and pre-recorded earlier images thus alternating between current and pre-recorded earlier images.

3. The method according to claim 2, further comprising, before displaying said current and pre-recorded earlier images, fixing a geographical position of said successive current and pre-recorded earlier images.

4. A system for detecting improvised explosive devices, partially or totally concealed on a path or in a vicinity thereof, from a vehicle following said path, the system comprising:

at least one shooting source mounted on said vehicle following said path and configured for delivering current images of the path;

a database of pre-recorded earlier images of said path;

an image processing device for processing images in real time, to which the at least one shooting source and said database are connected, said image processing device removes at least some of said current images and substitutes the removed current images with some of said pre-recorded earlier images from said database taken of said path to produce an ordered combination of current images and pre-recorded earlier images; and a device for displaying the ordered combination;

wherein said current images taken by said source are sent into said database via a link so as to update said pre-recorded earlier images of said database with the current images taken by the at least one source.

5. The system according to claim 4, wherein said image processing device replaces one current image out of two current images taken by the at least one source with one pre-recorded earlier image stored in said database so as to visualize on said display device an alternate succession of said current image and said pre-recorded earlier image.

6. The system according to claim 4, wherein said system further comprises a means for fixing a geographical position of two respectively current and pre-recorded earlier images.

7. The system according to claim 4, wherein the at least one shooting source is a camera and said display device is a monitor.

8. The system according to claim 4, wherein said earlier image database contains images supplied by the same shooting source.

9. The system according to claim 4, wherein said database is shared by several vehicles.

10. The method according to claim 1, further comprising fixing a geographical position of said current images and said pre-recorded earlier images to fix points in said current and pre-recorded earlier images so that the fixed points of said current and pre-recorded earlier images match.

11. The method according to claim 10, further comprising superimposing said fixed current images and said fixed pre-recorded earlier images.

12. The method according to claim 1, further comprising automatically detecting and emphasizing elements, by the image processing device, that have been modified in the current images compared to the pre-recorded earlier images.

13. The method according to claim 1, further comprising reducing effect of variations of brightness or shadows cast between said current images and said pre-recorded earlier images.

14. The method according to claim 1, further comprising detecting said improvised explosive devices.

15. The system according to claim 4, further comprising a device for superimposing said current images and said pre-recorded earlier images to form fixed current images.

16. The system according to claim 15, wherein said current images are fixed from a position of the vehicle and orientation of a shooting source on the vehicle.

17. The system according to claim 4, wherein the image processing device automatically detects and emphasizes elements that have been modified.

18. The system according to claim 4, wherein the device for processing images reduces effect of variations of brightness or shadows cast between said current images and said pre-recorded earlier images.

19. The system according to claim 15, wherein a common portion of said superimposed images is displayed.

* * * * *